US009124036B2

(12) United States Patent
Tai et al.

(10) Patent No.: US 9,124,036 B2
(45) Date of Patent: Sep. 1, 2015

(54) ELECTRICAL CONNECTOR WITH IMPROVED GROUNDING MEMBER FOR CROSS-TALK PREVENTION

(71) Applicant: ALLTOP ELECTRONICS (SUZHOU) LTD., Taicang, JiangSu Province (CN)

(72) Inventors: Hung-Chi Tai, Jhonghe (TW); Yi-Chang Chen, Jhonghe (TW); Chun-Hsien Wu, Jhonghe (TW); Kun Liu, Taicang (CN)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 92 days.

(21) Appl. No.: 13/869,470

(22) Filed: Apr. 24, 2013

(65) Prior Publication Data

US 2014/0220799 A1 Aug. 7, 2014

(30) Foreign Application Priority Data

Feb. 5, 2013 (CN) ..... 2013 1 0045152

(51) Int. Cl.

| | |
|---|---|
| ***H01R 13/6461*** | (2011.01) |
| ***H01R 12/72*** | (2011.01) |
| ***H01R 13/6594*** | (2011.01) |
| ***H01R 13/6596*** | (2011.01) |

(52) U.S. Cl.

CPC ..... *H01R 13/6461* (2013.01); *H01R 12/724* (2013.01); *H01R 13/6594* (2013.01); *H01R 13/6596* (2013.01)

(58) Field of Classification Search

USPC ..... 439/541.5, 108, 540.1, 660, 79, 607.23, 439/607.01

See application file for complete search history.

(56) References Cited

U.S. PATENT DOCUMENTS

| | | | | |
|---|---|---|---|---|
| 6,540,563 | B1 * | 4/2003 | Hu et al. | 439/676 |
| 6,688,914 | B1 * | 2/2004 | Espenshade et al. | 439/541.5 |
| 6,835,092 | B2 * | 12/2004 | Wan et al. | 439/541.5 |
| 6,997,754 | B2 * | 2/2006 | Wan et al. | 439/676 |
| 7,044,779 | B1 * | 5/2006 | Liu | 439/541.5 |
| 7,241,174 | B2 * | 7/2007 | Tsai | 439/607.25 |
| 7,384,310 | B2 * | 6/2008 | Hu et al. | 439/607.01 |
| 7,604,490 | B2 * | 10/2009 | Chen et al. | 439/79 |
| 7,670,173 | B2 * | 3/2010 | Hu et al. | 439/541.5 |
| 7,758,380 | B2 * | 7/2010 | Wang et al. | 439/607.23 |
| 7,806,722 | B2 * | 10/2010 | Yu et al. | 439/540.1 |
| 7,841,894 | B2 * | 11/2010 | Gong et al. | 439/541.5 |
| 7,967,631 | B2 * | 6/2011 | Wang et al. | 439/541.5 |
| 8,052,476 | B2 * | 11/2011 | Zheng et al. | 439/660 |
| 8,109,795 | B2 * | 2/2012 | Lin et al. | 439/660 |

* cited by examiner

*Primary Examiner* — Alexander Gilman

(74) *Attorney, Agent, or Firm* — Sughrue Mion, PLLC

(57) ABSTRACT

An electrical connector includes a housing member, a first contact group, a second contact group, a metallic shell and a grounding member. The housing member includes a first tongue plate and a second tongue plate to which the first contact group and the second contact group are respectively associated. The first contact group and the second contact group are compatible to USB 3.0 standard. The grounding member comprises a body portion located between the second mounting portions of the first contact group and the third mounting portions of the second contact group. The grounding member is electrically and mechanically connected to the metallic shell for cross-talk prevention.

18 Claims, 8 Drawing Sheets

ELECTRICAL CONNECTOR WITH IMPROVED GROUNDING MEMBER FOR CROSS-TALK PREVENTION

BACKGROUND OF THE INVENTION

1. Field of the Invention

The present invention relates to an electrical connector, and more particularly, to an electrical connector compatible to USB 3.0 standard with robust cross-talk prevention.

2. Description of Related Art

With rapid development of electronic technologies, electrical connectors have been widely used in electronic devices for exchanging information, data etc. with external devices. A conventional electrical connector includes an insulative housing and a plurality of contacts received in the insulative housing. Tail portions of the contacts extend backwardly beyond the insulative housing for being soldered to a printed circuit board.

In order to meet the manufacturing requirements of miniaturization and modularization electrical devices, electrical connectors therein are integrally designed to have multi-layer configurations. However, the contacts of different layers of the conventional multi-layer connectors are too close to each other as a result that cross-talk and high impedance easily occur during high frequent signal transmission.

Hence, it is desired to provide an electrical connector to overcome the problems mentioned above.

BRIEF SUMMARY OF THE INVENTION

The present invention provides an electrical connector including a housing member, a first contact group, a second contact group, a metallic shell and a grounding member electrically and mechanically connected to the metallic shell. The housing member includes a first tongue plate and a second tongue plate parallel to the first tongue plate. The first tongue plate and the second tongue plate are located one above the other along a height direction of the electrical connector. The first contact group is associated to the first tongue and comprises a plurality of first contacts and a plurality of second contacts. Each first contact includes a first contacting portion and a first mounting portion perpendicular to the first contacting portion. Each second contact comprises a second contacting portion and a second mounting portion. The first contacting portions and the second contacting portions are arranged in two rows along a mating direction of the electrical connector. The first mounting portions and the second mounting portions are respectively arranged in first and second rows along the mating direction of the electrical connector. Similarly, the second contact group is associated to the second tongue and comprises a plurality of third contacts and a plurality of fourth contacts. Each third contact comprises a third contacting portion and a third mounting portion perpendicular to the third contacting portion. Each fourth contact comprises a fourth contacting portion and a fourth mounting portion. The third contacting portions and the fourth contacting portions are arranged in two rows along the mating direction of the electrical connector. The third mounting portions and the fourth mounting portions are respectively arranged in third and fourth rows along the mating direction of the electrical connector. The metallic shell shields the housing member, the first contact group and the second contact group. The grounding member comprises a body portion located between the second mounting portions of the first contact group and the third mounting portions of the second contact group.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
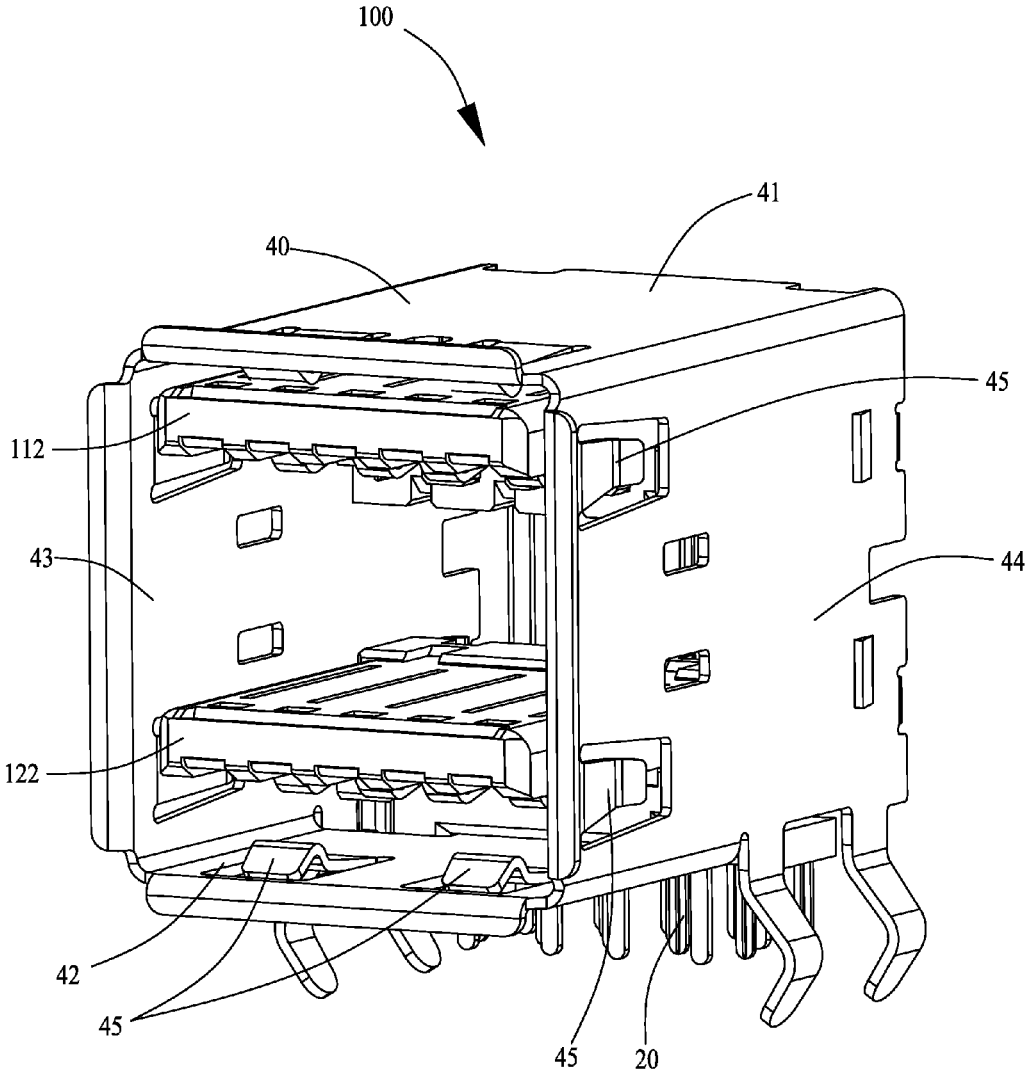
FIG. 1 is a perspective view of an electrical connector in accordance with a first illustrated embodiment of the present invention.

Reference will now be made to the drawing figures to describe the embodiments of the present invention in detail. In the following description, the same drawing reference numerals are used for the same elements in different drawings.

Figure 2:
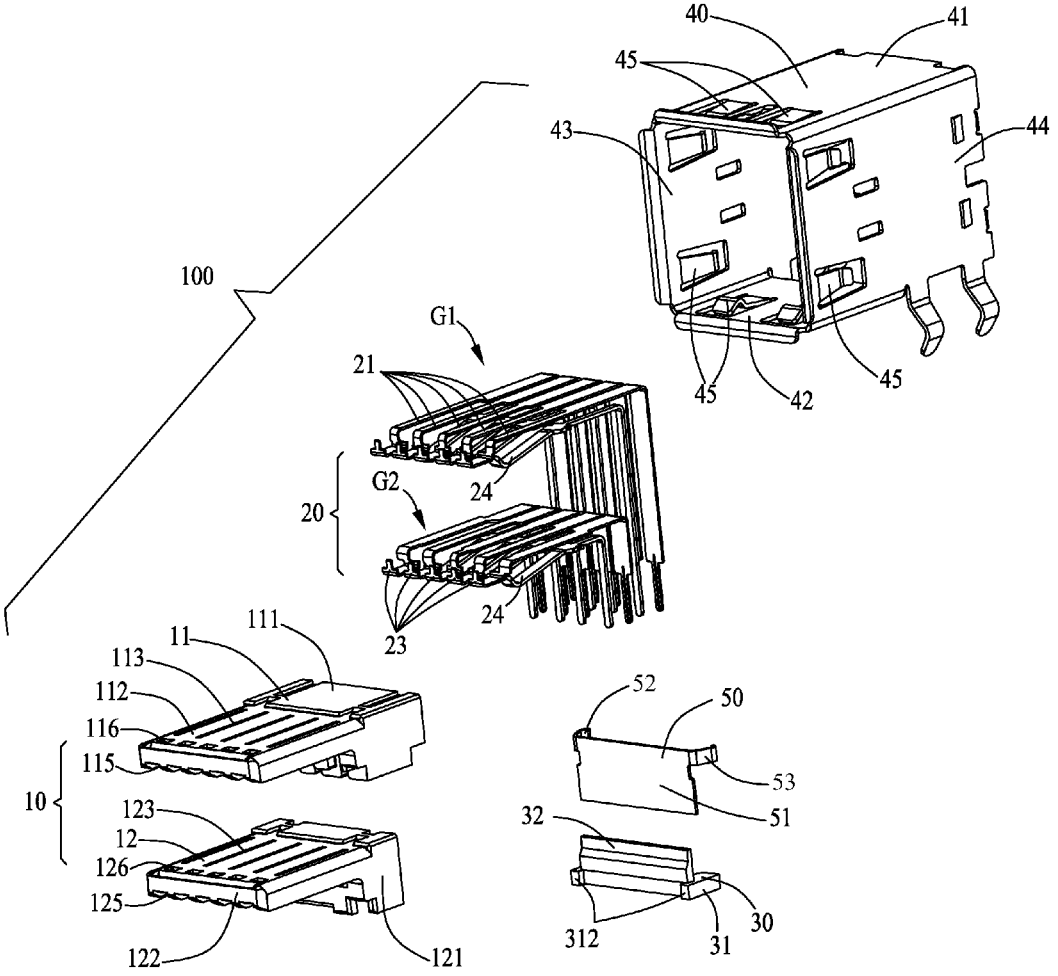
FIG. 2 is an exploded view of the electrical connector as shown in FIG. 1.
Figure 6:
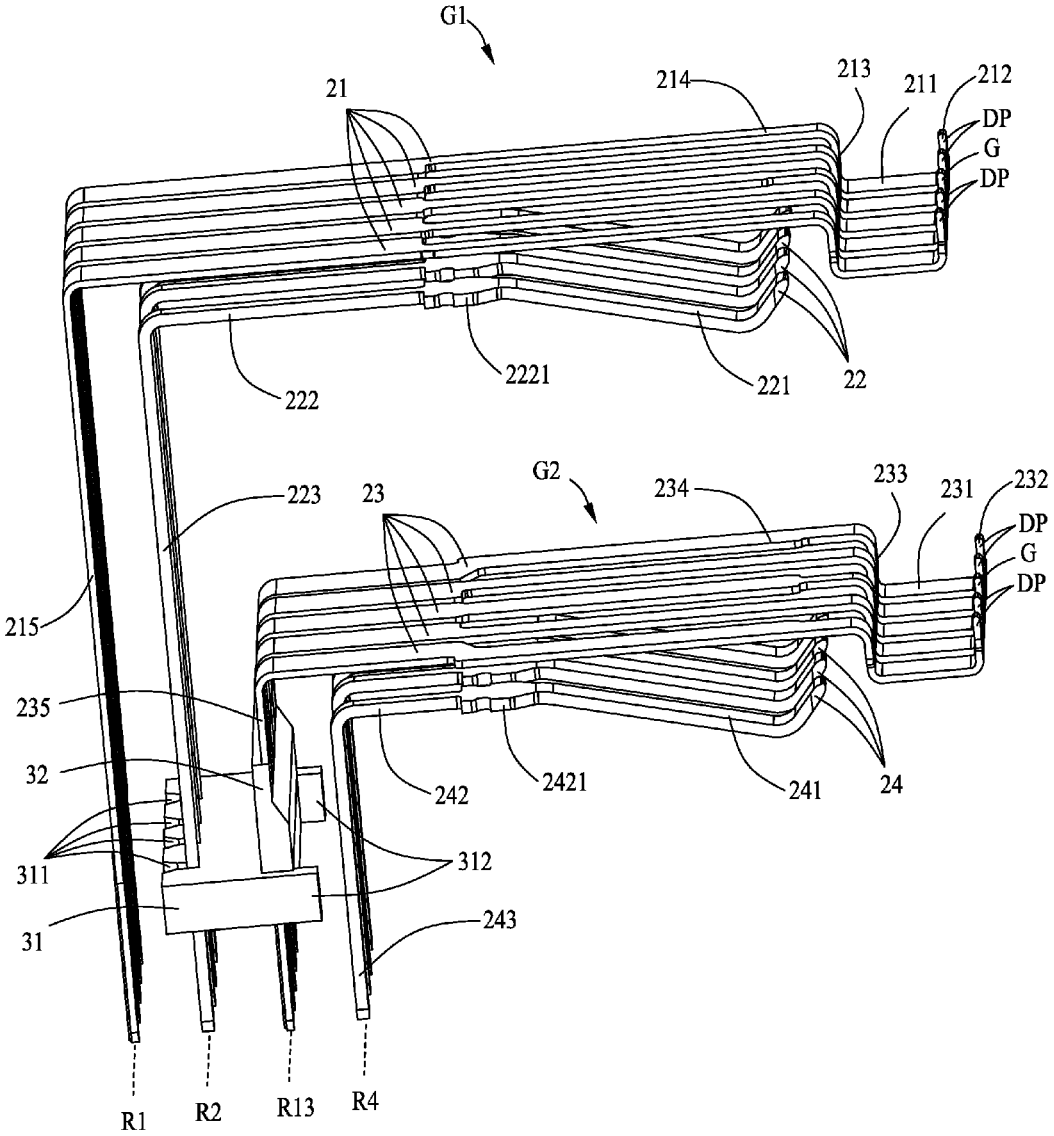
FIG. 6 is a perspective view of a first contact group, a second contact group and a spacer showing relationship thereof.

Referring to FIGS. 1 and 2, the present invention discloses an electrical connector 100 for mounting to a PCB (not shown). The electrical connector 100 includes a housing member 10, a plurality of contacts 20 retained in the housing member 10, a spacer 30 for organizing the contacts 20 and a metallic shell 40 shielding the insulative housing 10 and the contacts 20 for EMI protection. Referring to FIG. 6, the contacts 20 are divided into a first/upper contact group G1 and a second/lower contact group G2 according to the illustrated embodiment of the present invention. The first contact group G1 includes five first contacts 21 and four second contacts 22 inside the first contacts 21. Similarly, the second contact group G2 includes five third contacts 23 and four fourth contacts 24 inside the third contacts 23.

Figure 3:
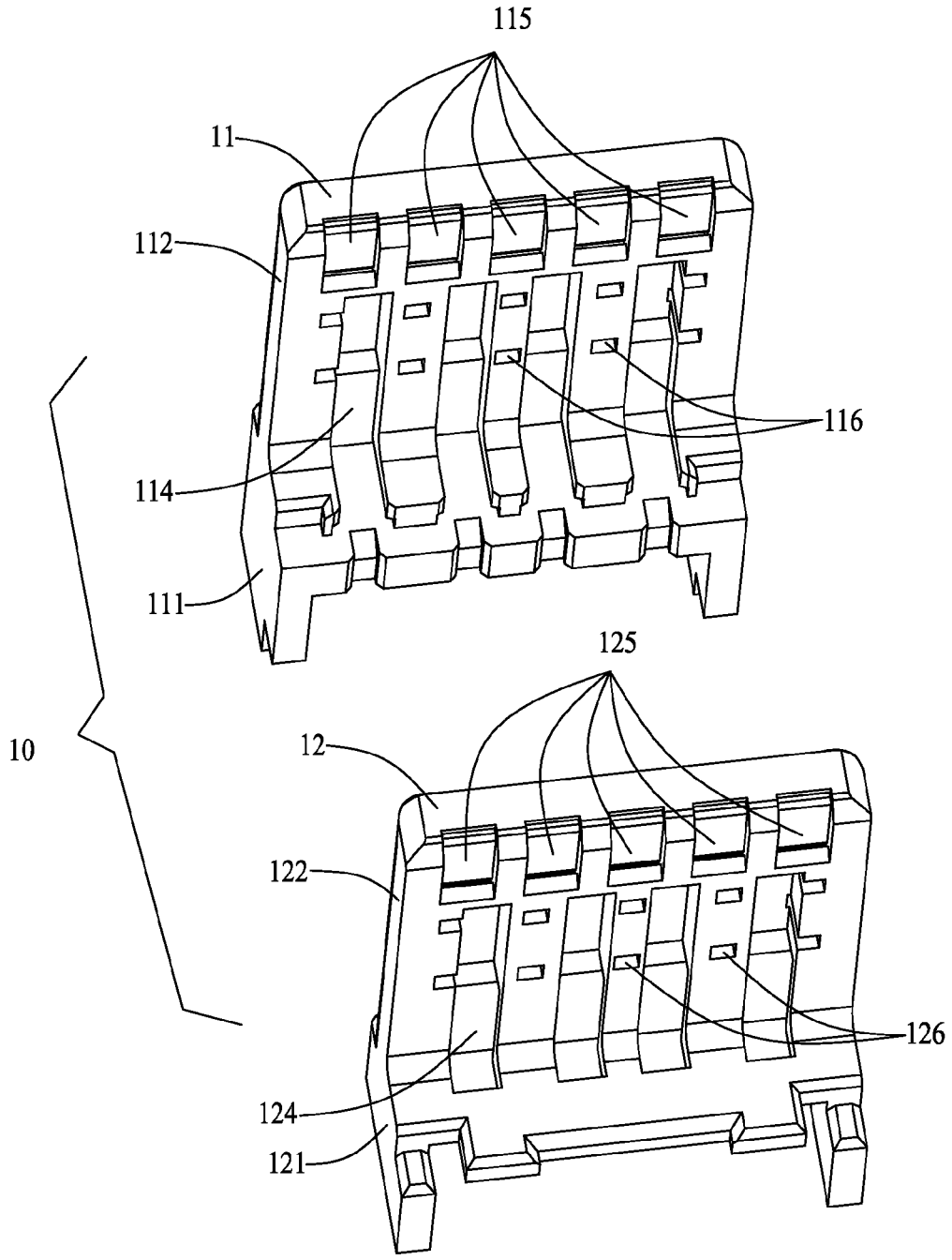
FIG. 3 is a perspective view of a housing member of the electrical connector as shown in FIG. 2.

Referring to FIGS. 2 and 3, the housing member 10 includes a first housing 11 and a second housing 12. The first housing 11 and the second housing 12 can either be separated from or integral with each other. The first housing 11 includes a first base portion 111 and a first tongue plate 112 extending horizontally and forwardly from the first base portion 111. Similarly, the second housing 12 includes a second base portion 121 and a second tongue plate 122 extending horizontally and forwardly from the second base portion 121. According to the illustrated embodiment of the present invention, the first tongue plate 112 and the second tongue plate 122 are parallel to each other, and the first tongue plate 112 is located above the second tongue plate 122 along a height direction of the electrical connector 100.

Referring to FIGS. 2 and 3, the first housing 11 includes a plurality of first receiving slots 113 for receiving the first contacts 21 and a plurality of second receiving slots 114 for assembling the second contacts 22. The first receiving slots 113 extend backwardly through the first base portion 111 and extend forwardly to the first tongue plate 112. The second receiving slots 114 are formed on a bottom surface of the first tongue plate 112. The second receiving slots 114 extend backwardly through the first base portion 111. As a result, heat generated from the second contacts 22 can be directly dissipated to the air via the second receiving slots 114.

Besides, the first tongue plate 112 defines a plurality of first rectangular depressions 115 adjacent to a front end thereof. Furthermore, the first tongue plate 112 defines a plurality of first holes 116 in communication with corresponding first receiving slots 113 so that when the first contacts 21 are maintained in the first tongue plate 112, at least parts of the first contacts 21 are exposed to the air through the first holes 116. As a result, heat generated from the first contacts 21 can be effectively dissipated to the air.

Referring to FIGS. 2 and 3, similar to the first housing 11, the second housing 12 includes a plurality of third receiving slots 123 for receiving the third contacts 23 and a plurality of fourth receiving slots 124 for assembling the fourth contacts 24. The third receiving slots 123 extend backwardly through the second base portion 121 and extend forwardly to the second tongue plate 122. The fourth receiving slots 124 are formed on a bottom surface of the second tongue plate 122. The fourth receiving slots 124 extend backwardly through the second base portion 121. As a result, heat generated from the fourth contacts 24 can be directly dissipated to the air.

Besides, the second tongue plate 122 defines a plurality of second rectangular depressions 125 adjacent to a front end thereof. Furthermore, the second tongue plate 122 defines a plurality of second holes 126 in communication with corresponding third receiving slots 123 so that when the third contacts 23 are maintained in the second tongue plate 122, parts of the third contacts 23 are exposed to the air through the second holes 126. As a result, heat generated from the third contacts 23 can be effectively dissipated to the air.

Referring to FIG. 6, the first contacts 21 and the third contacts 23 include two pairs of differential contacts (DP) and a grounding contact (G) located therebetween for high-speed signal transmission. According to the illustrated embodiment of the present invention, the first contact group G1 and the second contact group G2 are compatible to USB 3.0 standard.

Figure 4:
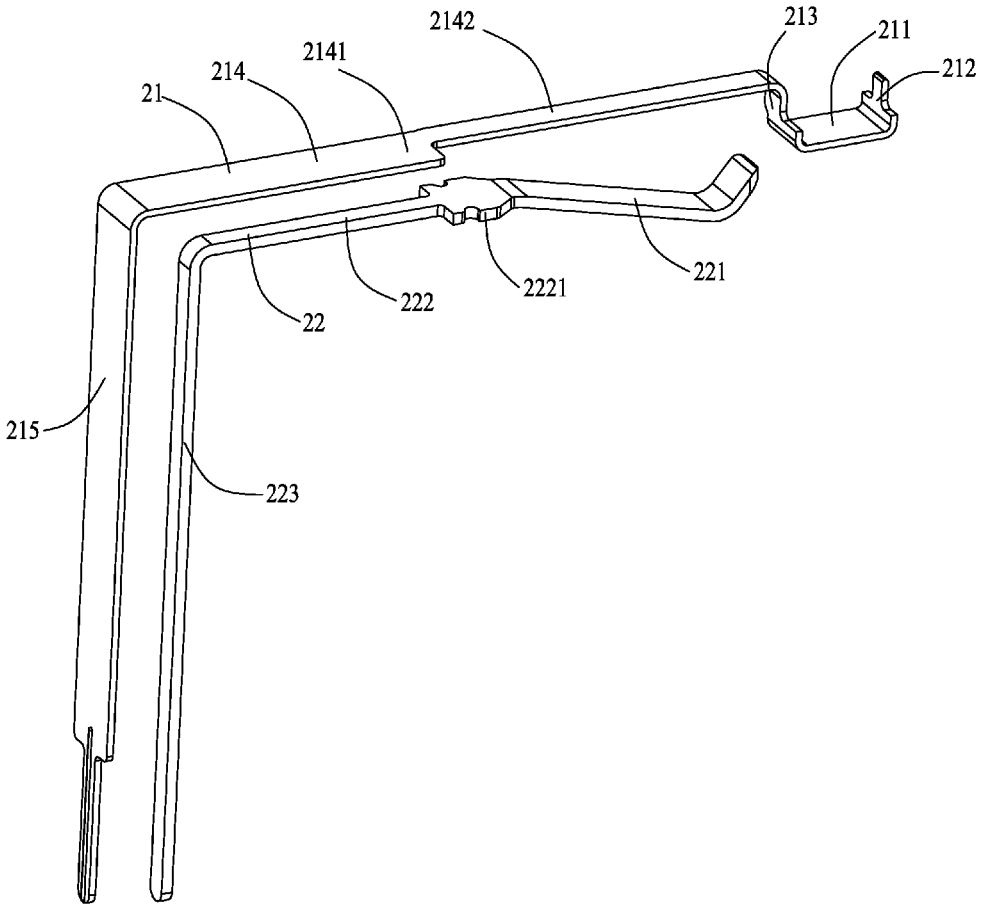
FIG. 4 is a perspective view of a first contact and a second contact showing relationship thereof.
Figure 5:
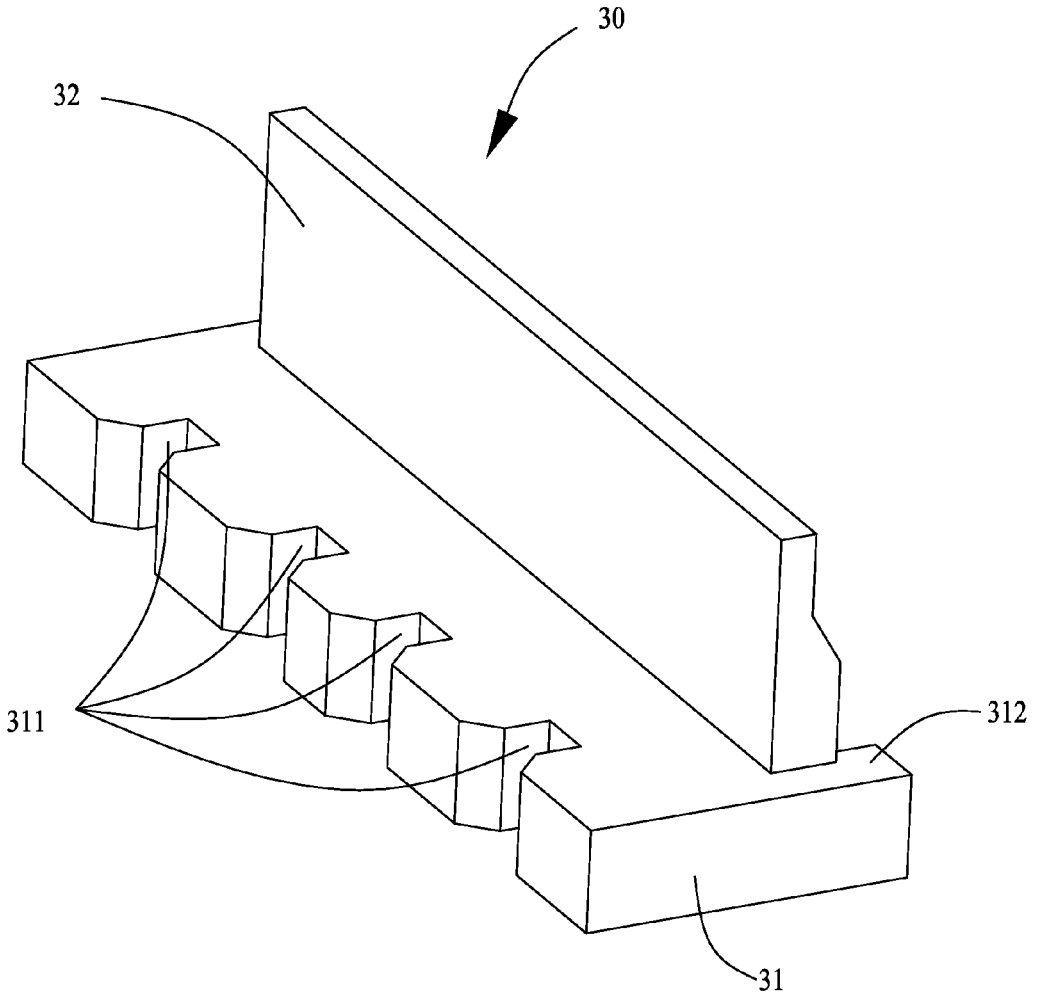
FIG. 5 is a perspective view of a spacer as shown in FIG. 2.

Referring to FIGS. 4 and 6, each first contact 21 includes a first contacting portion 211 received in the first rectangular depression 115, a first tab 212 bent outwardly from a front end of the first contacting portion 211, a first bent portion 213 bent outwardly from a rear end of the first contacting portion 211, a first connecting beam 214 extending horizontally and backwardly from the first bent portion 213, and a first mounting portion 215 bent downwardly from the first connecting beam 214. The first tab 212, the first bent portion 213 and the first contacting portion 211 form a U-shape configuration. The first connecting beam 214 is located above and extends in parallel to the first contacting portion 211. Besides, the first mounting portion 215 is perpendicular to the first contacting portion 211. The first connecting beam 214 includes a wider rear portion 2141 connecting the first mounting portion 215 and a narrower front portion 2142 connecting the first bent portion 213.

Each second contact 22 includes a resilient second contacting portion 221, a second connecting beam 222 extending backwardly from the second contacting portion 221, and a second mounting portion 223 bent downwardly from the second connecting beam 222. The second connecting beam 222 includes a plurality of barbs 2221 for stably holding the second contacts 22. The second mounting portion 223 is essentially perpendicular to the second contacting portion 221.

Referring to FIG. 6, each third contact 23 includes a third contacting portion 231 received in the second rectangular depression 125, a second tab 232 bent outwardly from a front end of the third contacting portion 231, a second bent portion 233 bent outwardly from a rear end of the third contacting portion 231, a third connecting beam 234 extending horizontally and backwardly from the second bent portion 233, and a third mounting portion 235 bent downwardly from the third connecting beam 234. The second tab 232, the second bent portion 233 and the third contacting portion 231 form a U-shape configuration. Besides, the third mounting portion 235 is perpendicular to the third contacting portion 231.

Each fourth contact 24 includes a resilient fourth contacting portion 241, a fourth connecting beam 242 extending backwardly from the fourth contacting portion 241, and a fourth mounting portion 243 bent downwardly from the fourth connecting beam 242. The fourth connecting beam 242 includes a plurality of barbs 2421 for stably holding the fourth contacts 24. The fourth mounting portion 243 is essentially perpendicular to the fourth contacting portion 241.

Figure 7:
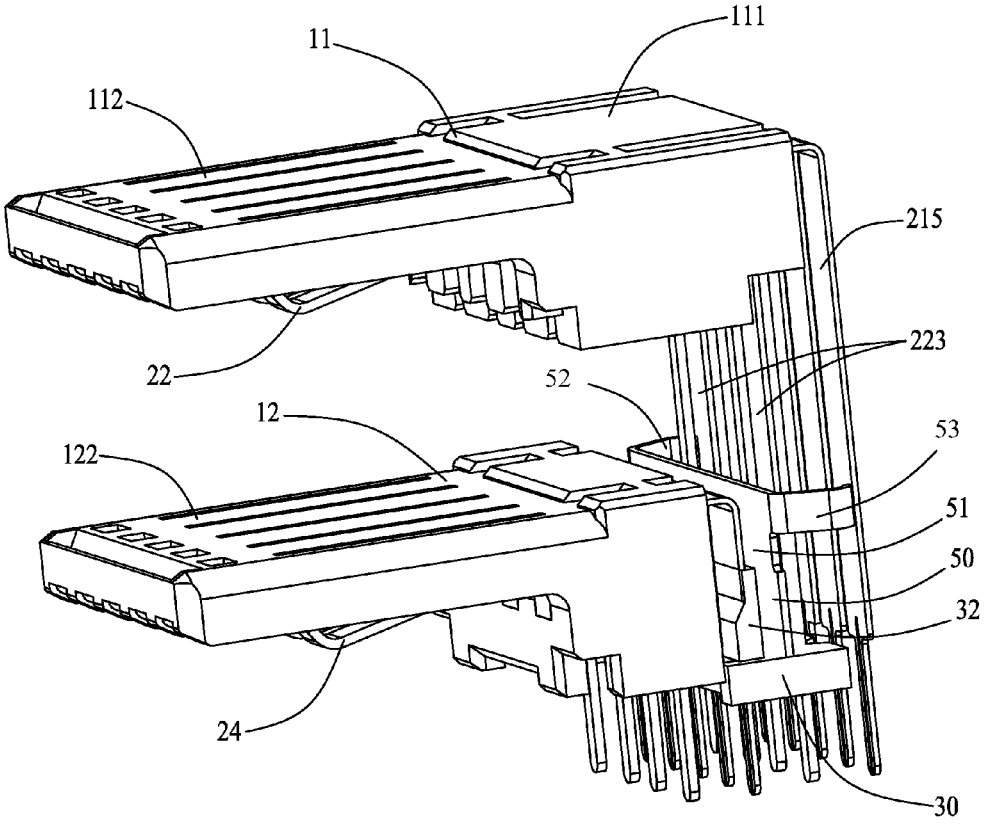
FIG. 7 is a perspective of the electrical connector without a metallic shell in accordance with a first illustrated embodiment of the present invention.
Figure 8:
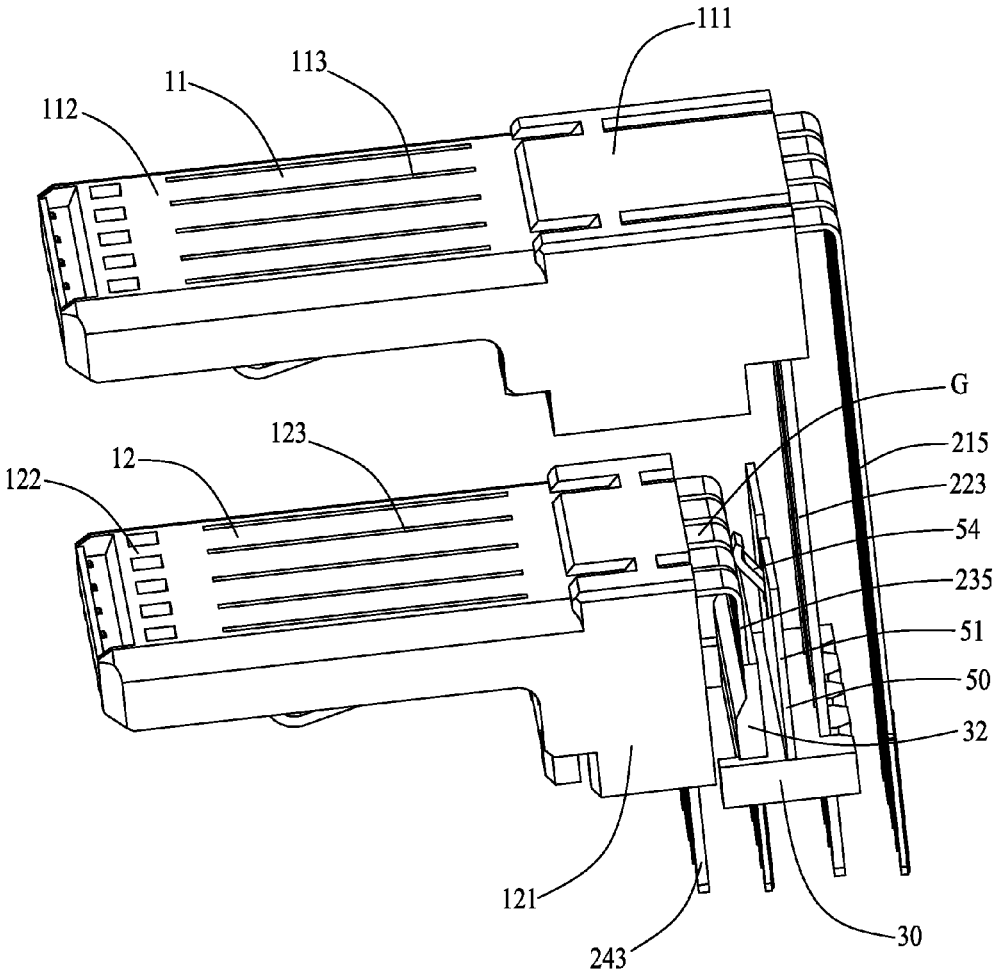
FIG. 8 is a perspective of the electrical connector without a metallic shell in accordance with a second illustrated embodiment of the present invention.

Referring to FIGS. 6 to 8, the first contacting portions 211 and the second contacting portions 221 are arranged in two rows along a mating direction of the electrical connector 100. Similarly, the third contacting portions 231 and the fourth contacting portions 241 are arranged in two rows along the mating direction of the electrical connector 100 as well. The first mounting portions 215, the second mounting portions 223, the third mounting portions 235 and the fourth mounting portions 243 are respectively arranged in first, second, third and fourth rows (R1, R2, R3 and R4) along the mating direction of the electrical connector 100.

Referring to FIGS. 7 and 8, according to the illustrated embodiment of the present invention, the first contacts 21 and the third contacts 23 are insert-molded with the first housing 11 and the second housing 12, respectively for simplifying assembling. The first tabs 212 and the second tabs 232 are adapted for stably fixing the first contacts 21 and the third contacts 23 in the first housing 11 and the second housing 12, respectively. However, in other embodiments, the first contacts 21 and the third contacts 23 can also be assembled to the first housing 11 and the second housing 12, respectively.

Referring to FIGS. 2 to 8, the spacer 30 is located between and is separated from the first mounting portions 215 and the fourth mounting portions 243 along the mating direction. The second mounting portions 223 and the third mounting portions 235 are regulated by the spacer 30. In detail, the spacer 30 includes a base 31 and a retaining wall 32 extending upwardly from the base 31. The base 31 defines a plurality of slots 311 through which the second mounting portions 223 extend. The third mounting portions 235 are integrally molded with the retaining wall 32 through insert-molding technology. As shown in FIG. 6, the base 31 includes a pair of tails 312 extending backwardly beyond the retaining wall 32.

Referring to FIG. 2, the metallic shell 40 includes a top wall 41, a bottom wall 42, a first side wall 43 and a second side wall 44 opposite to the first side wall 43. Each of the top wall 41, the bottom wall 42 and the side walls 43, 44 includes a pair of engaging arms 45 extending inwardly for abutting against a mating connector (not shown).

Referring to FIGS. 2 and 7, according to the illustrated embodiment of the present invention, the electrical connector 100 is also provided with a grounding member 50 for cross-talk prevention when the first and the second contact groups G1, G2 are in high-speed signal transmission. The grounding member 50 is metallic and is fixed to the spacer 30. According to the first embodiment, the grounding member 50 includes a flat body portion 51, a first resilient arm 52 and a second resilient arm 53 extending sidewardly from a top side of the body portion 51. The body portion 51 is essentially lies in a vertical plane and is located between the second mounting portions 223 of the first contact group G1 and the third mounting portions 235 of the second contact group G2. The first resilient arm 52 and the second resilient arm 53 mechanically and electrically engage against the first side wall 43 and the second side wall 44 of the metallic shell 40, respectively. The first resilient arm 52 and the second resilient arm 53 are symmetrical with each other. The first resilient arm 52 and the second resilient arm 53 are located outside of the second mounting portions 223 and embrace the second mounting portions 223. As a result, cross-talk between the second mounting portions 223 and the third mounting portions 235 can be effectively prevented by the grounding member 50. Besides, the grounding member 50 can be used to effectively control high impedance.

Referring to FIG. 8, according to the second embodiment of the present invention, the body portion 51 includes an elastic arm 54 electrically and mechanically connected to the third mounting portion 235 of the grounding contact (G) for increasing grounding area. The elastic arm 54 is stamped outwardly from the body portion 51. As a result, cross-talk between the second mounting portions 223 and the third mounting portions 235 can be effectively prevented by the grounding member 50. Besides, the grounding member 50 can be used to effectively control high impedance.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

a housing member comprising a first tongue plate and a second tongue plate parallel to the first tongue plate, the first tongue plate and the second tongue plate being located one above the other along a height direction of the electrical connector;

a first contact group associated to the first tongue and comprising a plurality of first contacts and a plurality of second contacts, each first contact comprising a first contacting portion and a first mounting portion perpendicular to the first contacting portion, each second contact comprising a second contacting portion and a second mounting portion, the first contacting portions and the second contacting portions being arranged in two rows along a mating direction of the electrical connector, the first mounting portions and the second mounting portions being respectively arranged in first and second rows along the mating direction of the electrical connector;

a second contact group associated to the second tongue and comprising a plurality of third contacts and a plurality of fourth contacts, each third contact comprising a third contacting portion and a third mounting portion perpendicular to the third contacting portion, each fourth contact comprising a fourth contacting portion and a fourth mounting portion, the third contacting portions and the fourth contacting portions being arranged in two rows along the mating direction of the electrical connector, the third mounting portions and the fourth mounting portions being respectively arranged in third and fourth rows along the mating direction of the electrical connector;

a metallic shell shielding the housing member, the first contact group and the second contact group; and a grounding member electrically and mechanically connected to the metallic shell, the grounding member comprising a body portion located between the second mounting portions of the first contact group and the third mounting portions of the second contact group;

a spacer located between the first mounting portions and the fourth mounting portions, the second mounting portions and the third mounting portions being regulated by the spacer, the body portion of the grounding member being fixed by the spacer;

wherein the spacer comprises a base and a retaining wall extending upwardly from the base, the base defining a plurality of slots through which the second mounting portions extend, the third mounting portions being integrally molded with the retaining wall.

2. The electrical connector as claimed in claim 1, wherein the metallic shell comprises a first side wall and a second side wall opposite to the first side wall, the grounding member comprising a first resilient arm engaging against the first side wall and a second resilient arm engaging against the second side wall.

3. The electrical connector as claimed in claim 2, wherein the first resilient arm and the second resilient arm extend sidewardly from a top side of the body portion.

4. The electrical connector as claimed in claim 3, wherein the first resilient arm and the second resilient arm are symmetrical with each other.

5. The electrical connector as claimed in claim 2, wherein the first resilient arm and the second resilient arm are located outside of the second mounting portions and embrace the second mounting portions.

6. The electrical connector as claimed in claim 1, wherein the housing member comprises a first housing and a second housing, the first tongue plate and the second tongue plate being respectively formed on the first housing and the second housing, the first contacts and the third contacts being respectively insert molded with the first housing and the second housing.

7. The electrical connector as claimed in claim 6, wherein the second housing is separated from or integral with the first housing.

8. The electrical connector as claimed in claim 1, wherein the first contact group and the second contact group are compatible to USB 3.0 standard.

9. An electrical connector comprising:

a housing member comprising a first tongue plate and a second tongue plate;

a first contact group associated to the first tongue and comprising a plurality of first contacts and a plurality of second contacts, each first contact comprising a first contacting portion and a first mounting portion perpendicular to the first contacting portion, each second contact comprising a second contacting portion and a second mounting portion, the first contacting portions and the second contacting portions being arranged in two rows along a mating direction of the electrical connector, the first mounting portions and the second mounting portions being respectively arranged in first and second rows along the mating direction of the electrical connector;

a second contact group associated to the second tongue and comprising a plurality of third contacts and a plurality of fourth contacts, the plurality of third contacts comprising two pairs of differential contacts and a grounding contact located therebetween, each third contact comprising a third contacting portion and a third mounting portion perpendicular to the third contacting portion, each fourth contact comprising a fourth contacting portion and a fourth mounting portion, the third contacting portions and the fourth contacting portions being arranged in two rows along the mating direction of the electrical connector, the third mounting portions and the fourth mounting portions being respectively arranged in third and fourth rows along the mating direction of the electrical connector;

a metallic shell shielding the housing member, the first contact group and the second contact group;

a spacer comprising a base and a retaining wall extending upwardly from the base, the base defining a plurality of slots through which the second mounting portions extend, the third mounting portions being integrally molded with the retaining wall; and a grounding member located between the second mounting portions of the first contact group and the third mounting portions of the second contact group, the grounding member comprising an elastic arm electrically and mechanically connected to the third mounting portion of the grounding contact.

10. The electrical connector as claimed in claim 9, wherein the grounding member is metallic and comprises a vertical body portion, the elastic arm being stamped outwardly from the body portion.

11. The electrical connector as claimed in claim 10, wherein the body portion of the grounding member is fixed to the base of the spacer.

12. The electrical connector as claimed in claim 9, wherein the base of the spacer is located between the first mounting portions and the fourth mounting portions.

13. The electrical connector as claimed in claim 12, wherein the base of the spacer is separated from the first mounting portions and the fourth mounting portions along the mating direction of the electrical connector.

14. The electrical connector as claimed in claim 9, wherein the housing member comprises a first housing and a second housing, the first tongue plate and the second tongue plate being respectively formed on the first housing and the second housing, the first contacts and the third contacts being respectively insert molded with the first housing and the second housing.

15. The electrical connector as claimed in claim 14, wherein the second housing is separated from the first housing.

16. The electrical connector as claimed in claim 14, wherein the second housing is integral with the first housing.

17. The electrical connector as claimed in claim 9, wherein the first contact group and the second contact group are compatible to USB 3.0 standard.

18. The electrical connector as claimed in claim 9, wherein the base comprises a pair of tails extending backwardly beyond the retaining wall.

* * * * *